US011199371B2

(12) United States Patent
Miller

(10) Patent No.: US 11,199,371 B2
(45) Date of Patent: Dec. 14, 2021

(54) FIREARM ASSEMBLY SYSTEM AND METHOD

(71) Applicant: Michael D. Miller, Wichita, KS (US)

(72) Inventor: Michael D. Miller, Wichita, KS (US)

( * ) Notice: Subject to any disclaimer, the term of this patent is extended or adjusted under 35 U.S.C. 154(b) by 74 days.

(21) Appl. No.: 16/104,823

(22) Filed: Aug. 17, 2018

(65) Prior Publication Data

US 2019/0056188 A1 Feb. 21, 2019

Related U.S. Application Data

(60) Provisional application No. 62/546,888, filed on Aug. 17, 2017.

(51) Int. Cl.

| | |
|---|---|
| ***F41A 3/66*** | (2006.01) |
| ***F41A 21/48*** | (2006.01) |
| ***F41A 5/24*** | (2006.01) |
| ***F41A 11/00*** | (2006.01) |
| ***F41C 23/16*** | (2006.01) |
| ***F41A 3/72*** | (2006.01) |

(52) U.S. Cl.

CPC ..... *F41A 3/66* (2013.01); *F41A 3/72* (2013.01); *F41A 5/24* (2013.01); *F41A 11/00* (2013.01); *F41A 21/48* (2013.01); *F41A 21/482* (2013.01); *F41C 23/16* (2013.01)

(58) Field of Classification Search

CPC ..... F41A 3/66; F41A 21/48
USPC ..... 42/75.02
See application file for complete search history.

(56) References Cited

U.S. PATENT DOCUMENTS

| | | | | |
|---|---|---|---|---|
| 8,087,194 | B1 * | 1/2012 | Vuksanovich | F41A 21/48 42/75.02 |
| 8,769,855 | B2 | 7/2014 | Law | |
| 9,303,949 | B1 * | 4/2016 | Oglesby | F41C 23/16 |
| 2012/0131834 | A1 * | 5/2012 | Barrett | F41A 5/28 42/75.02 |
| 2012/0131835 | A1 * | 5/2012 | Barrett | F41A 21/481 42/75.02 |
| 2013/0174457 | A1 | 7/2013 | Law | |
| 2014/0033590 | A1 * | 2/2014 | Gomez | F41A 21/48 42/75.02 |
| 2016/0033225 | A1 * | 2/2016 | Selvetti | F41A 21/484 89/14.05 |
| 2016/0091276 | A1 * | 3/2016 | Miller | F41C 23/16 42/75.02 |

(Continued)

FOREIGN PATENT DOCUMENTS

| | | |
|---|---|---|
| WO | 2447091 | 9/1943 |
| WO | 20120017483 | 1/2012 |

(Continued)

OTHER PUBLICATIONS

"International Search Report and Written Opinion, PCT/US18/46995".

*Primary Examiner* — Joshua E Freeman
(74) *Attorney, Agent, or Firm* — Law Office of Mark Brown, LLC; Mark E. Brown

(57) ABSTRACT

A firearm configured for disassembly into stock, and receiver and barrel assemblies. Stock-receiver and receiver-barrel mounting assemblies facilitate assembling and disassembling the firearm. Modified components are adapted for placement on standard firearms and enable expedited assembly and disassembly. A firearm assembly method is also disclosed.

4 Claims, 24 Drawing Sheets

(56) References Cited

U.S. PATENT DOCUMENTS

| | | | | |
|---|---|---|---|---|
| 2019/0003796 | A1* | 1/2019 | Selvetti | F41A 3/66 |
| 2019/0086175 | A1* | 3/2019 | Karagias | F41A 21/482 |

FOREIGN PATENT DOCUMENTS

| | | |
|---|---|---|
| WO | 20160033225 | 2/2016 |
| WO | 9303949 | 4/2016 |
| WO | 9638484 | 5/2017 |
| WO | 20170160037 | 6/2017 |

* cited by examiner

FIREARM ASSEMBLY SYSTEM AND METHOD

CROSS-REFERENCE TO RELATED APPLICATION

This application claims priority in U.S. Provisional Patent Application No. 62/546,888 Filed Aug. 17, 2017, which is incorporated herein by reference.

BACKGROUND OF THE INVENTION

1. Field of the Invention

The present invention relates generally to firearm assembly and disassembly systems and methods, and more specifically to a system and method for the assembly and disassembly of a firearm in a compact configuration for portability and customizability.

2. Description of the Related Art

One drawback presented with the standard firearm gas system is that the gas tube runs down the length of the barrel from the gas block and then extends inside the AR upper receiver and into the gas key part of the firearm bolt. This gas tube eliminates the ability to screw off a barrel set up or barrel nut that holds the barrel to the upper receiver.

This inability to screw off the barrel also means that for transportation purposes, the firearm is longer and bulkier than necessary

BRIEF SUMMARY OF THE INVENTION

The present invention was developed to be a quick detachable AR platform firearms system. The idea is to be able to quickly and safely take the barrel and handrail off a firearm and change it to a different length or caliber barrel system. The main problem with the standard AR gas system is that you have a gas tube that runs down the length of the barrel from the gas block and then extends inside the AR upper receiver and into the gas key part of the firearm bolt. This gas tube eliminates the ability to screw off a barrel set up or barrel nut that holds the barrel to the upper receiver.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the muzzle and the butt of the firearm respectively. Said terminology will include the words specifically mentioned, derivatives thereof and words of similar meaning.

II. Preferred Embodiment Firearm Assembly System

Figure 1:
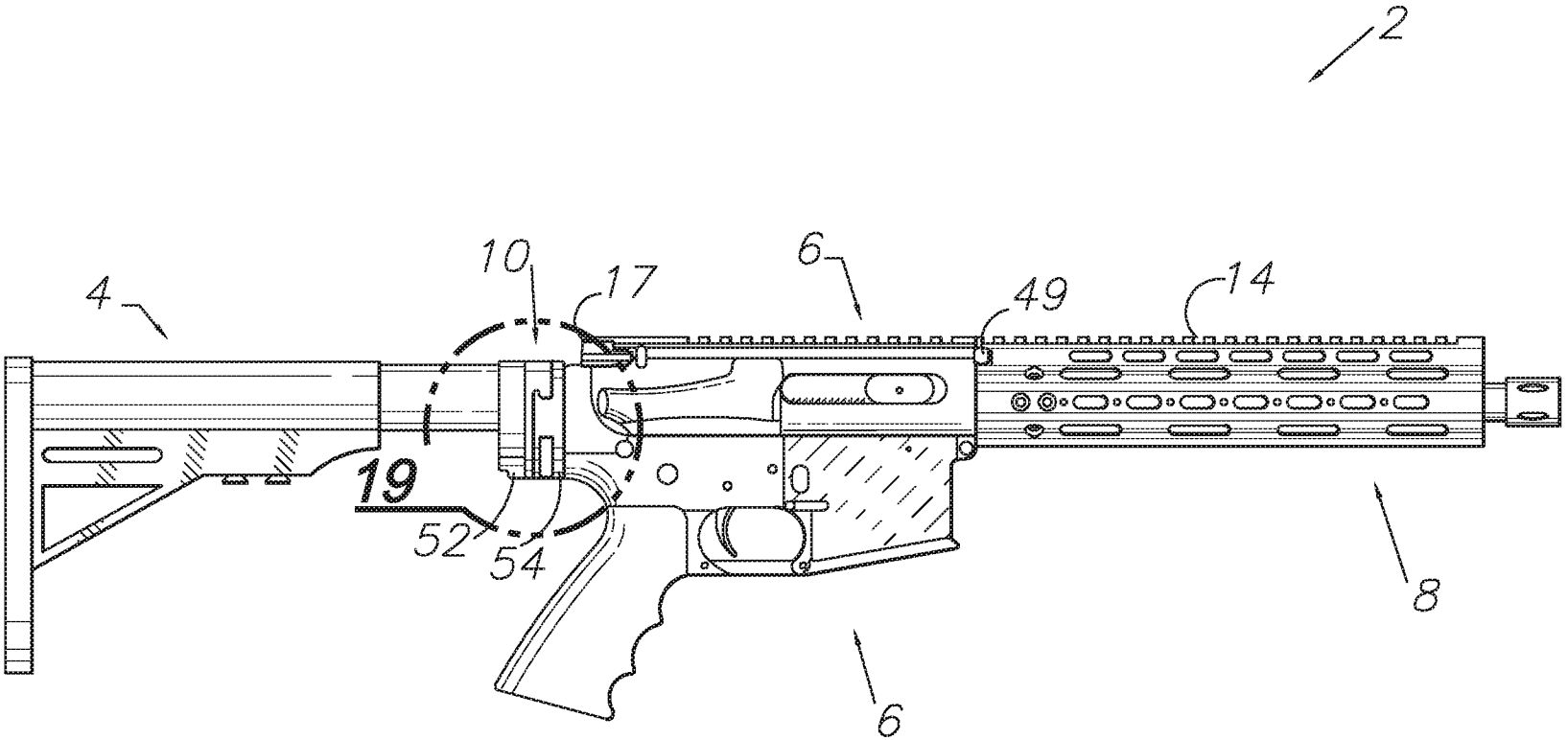
FIG. 1 is a right-side elevational view of a firearm (AR 15) in a fully-assembled state and embodying an aspect of the present invention.
Figure 3:
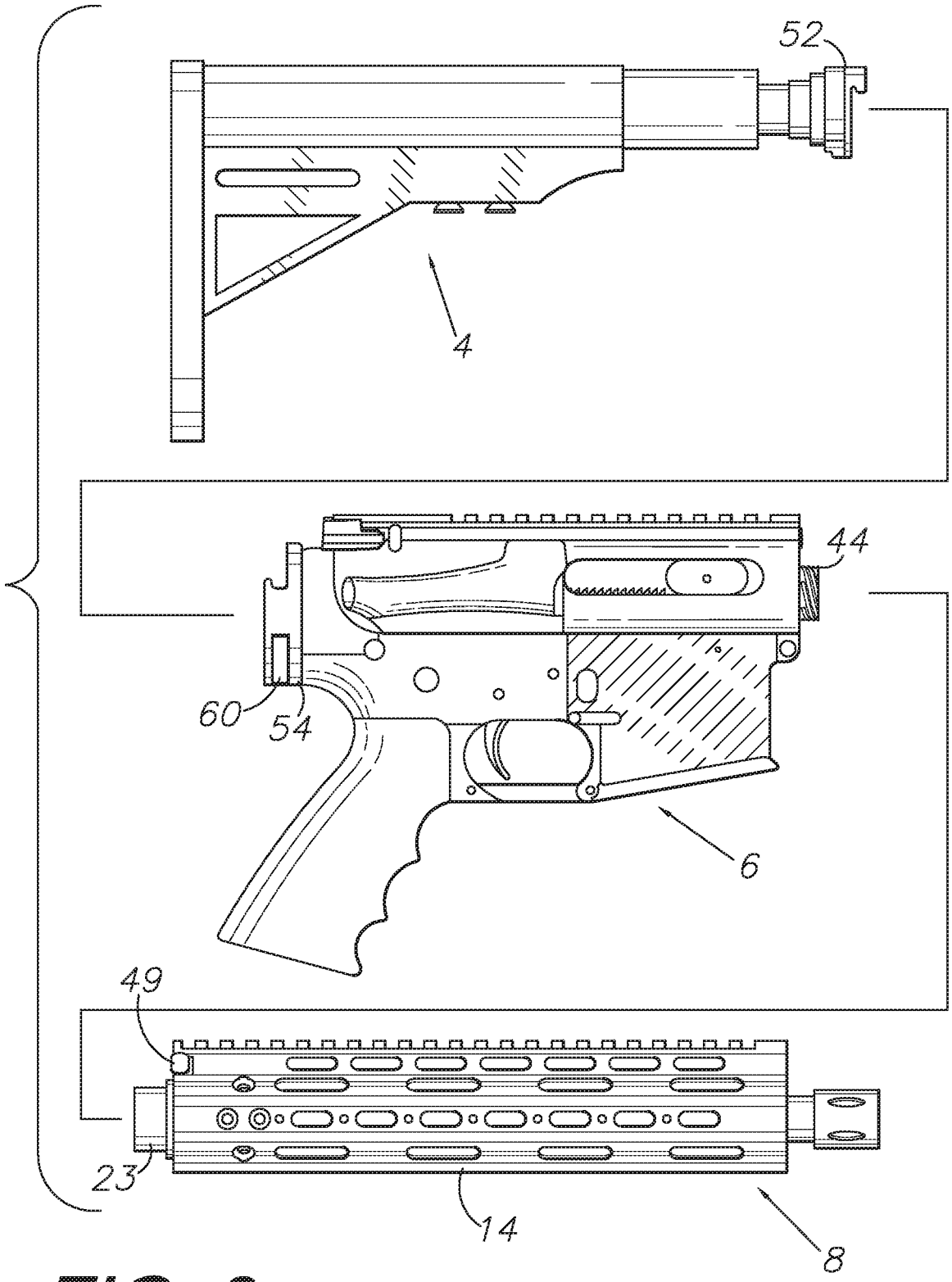
FIG. 3 is an exploded, elevational view thereof, particularly showing the stock, receiver and barrel assemblies separated.
Figure 4:
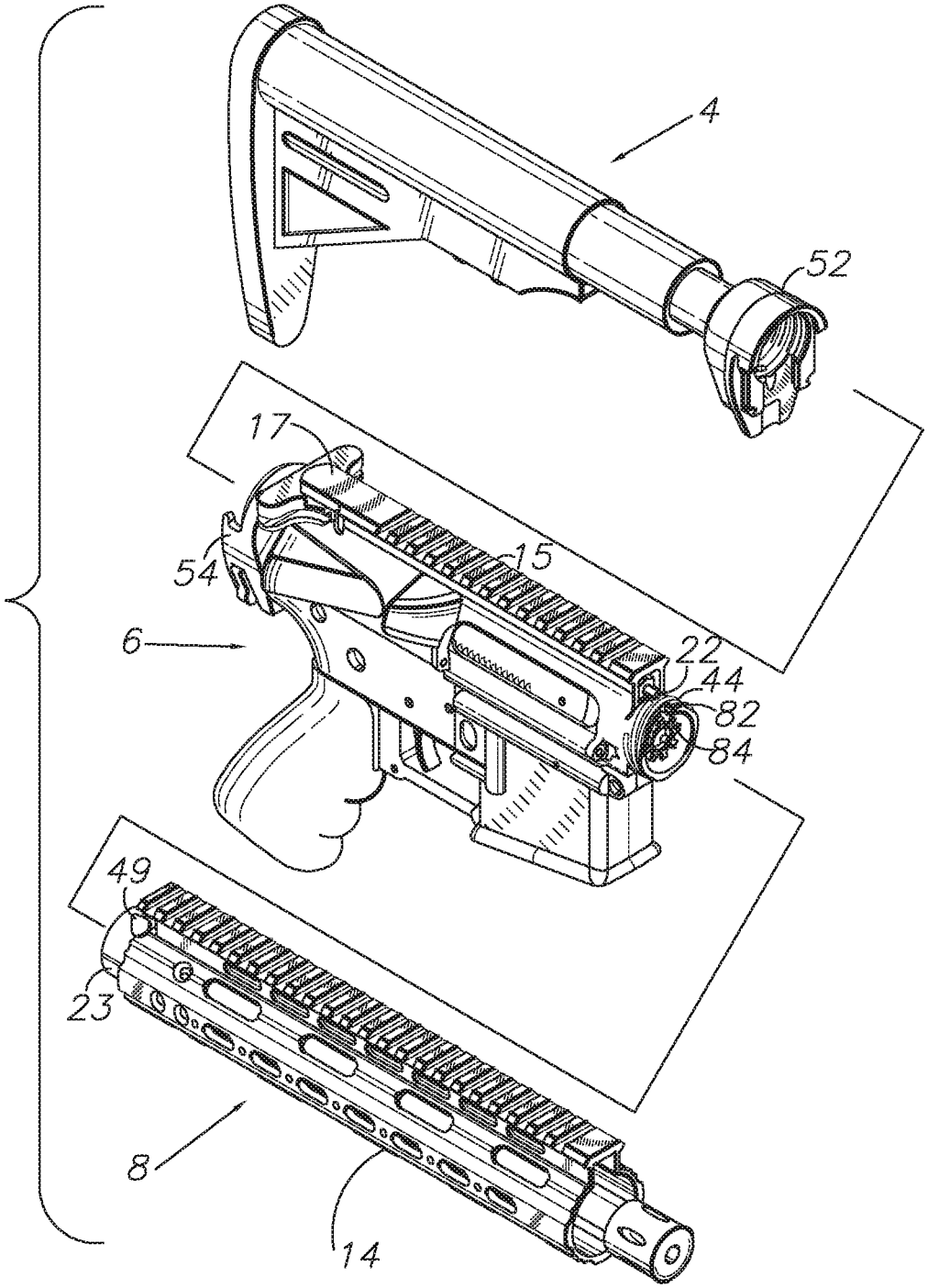
FIG. 4 is an exploded, perspective view of the separated stock, receiver and barrel assemblies.

Referring to the drawings more detail, FIG. 1 shows an AR 15 firearm (AR 15) 2, which embodies an aspect of the present invention. The assembly system and method are adaptable to a wide range of AR 15 variants, and other models of firearms. The firearm 2 generally comprises a stock assembly 4, a receiver assembly 6 and a barrel assembly 8, which can be readily disassembled to a relatively compact configuration, as shown in FIGS. 3 and 4, by disengaging a stock-receiver mounting assembly 10 and a receiver-barrel mounting assembly 12.

Figure 2:
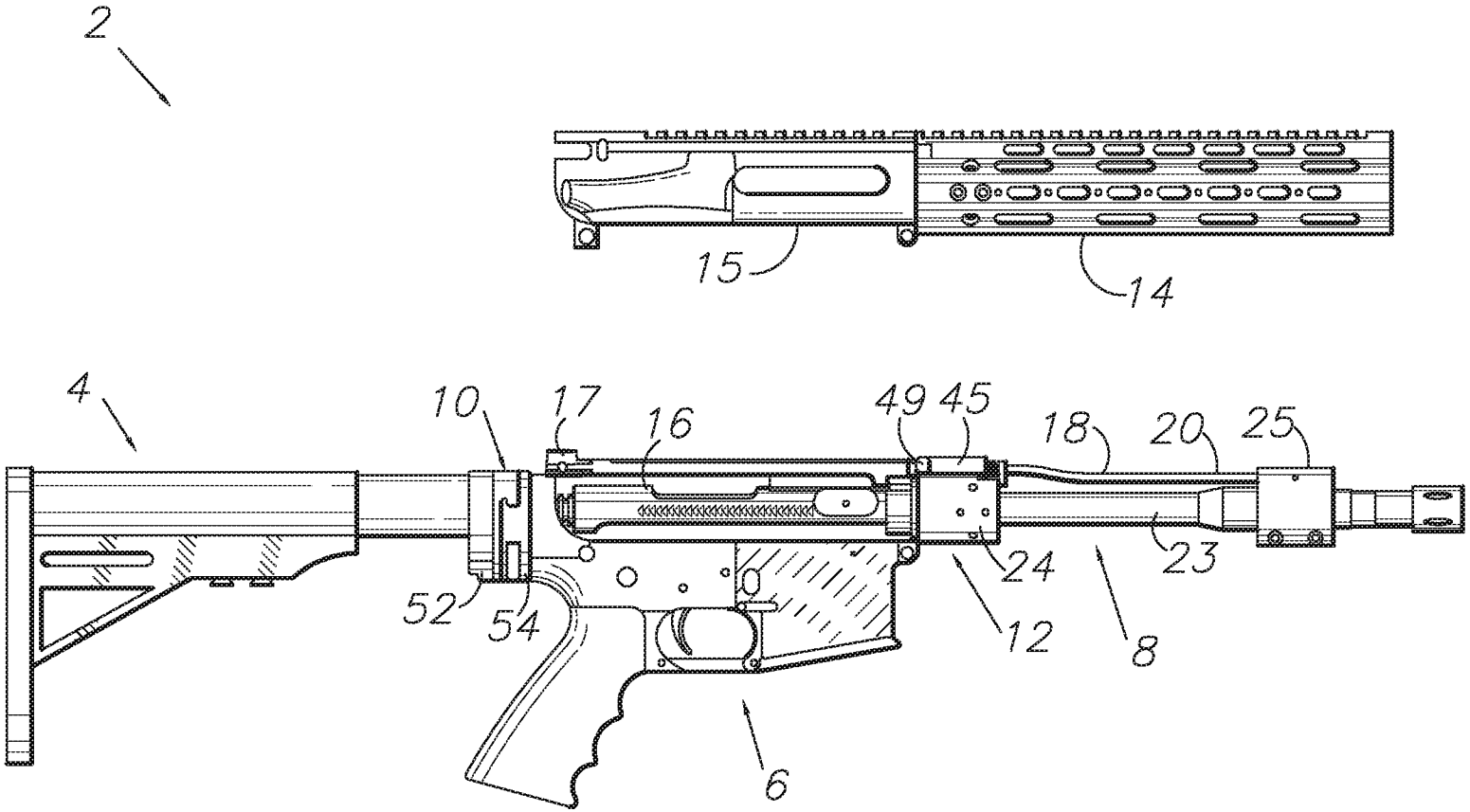
FIG. 2 is an exploded, elevational view thereof, particularly showing an upper receiver cover and a hand guard separated from a receiver assembly and a barrel assembly respectively.

FIG. 2 shows an upper receiver cover 15 and a hand guard 14 removed to illustrate internal components of the receiver and barrel assemblies. The receiver includes a bolt 16, which is conventional to AR 15 firearms. A modified gas tube 18 includes front and rear sections 20, 22 (FIG. 2). The front section 20 extends from a conventional gas block 25, which diverts high-pressure gas in a barrel 23. The diverted gas is conveyed rearwardly to a barrel nut 24, and is further conveyed through the gas tube rear section 22 for driving the bolt 16 rearwardly against a recoil spring (not shown) in the stock assembly 4. The compressed recoil spring then pushes the bolt 16 forwardly to chamber another round. This operation is conventional with gas-powered automatic and semi-automatic firearms, including AR 15*s*. FIGS. 3 and 4 show the firearm 2 disassembled into stock, receiver and barrel assemblies 4, 6, 8.

The modified AR 15 2 includes a modified charging handle 17, which is elongated compared to a conventional (OEM) charging handle and includes the gas tube rear section 22 therein. The gas tube rear section 22 extends forwardly from the charging handle front end. Alternatively, an adapter (not shown) with the configuration of the charging handle 17 front end can be mounted on a conventional AR 15 charging handle.

III. Stock-Receiver Mounting Assembly 10

The stock-receiver mounting assembly 10 includes a forwardly-extending plug 26, which is received in a conventional bolt carrier 28 and reciprocates within the mounting assembly 10 as the firearm 2 cycles with each shot. The stock assembly 14 includes a conventional action spring and buffer assembly, which engage and return the reciprocating plug 26.

Figure 13:
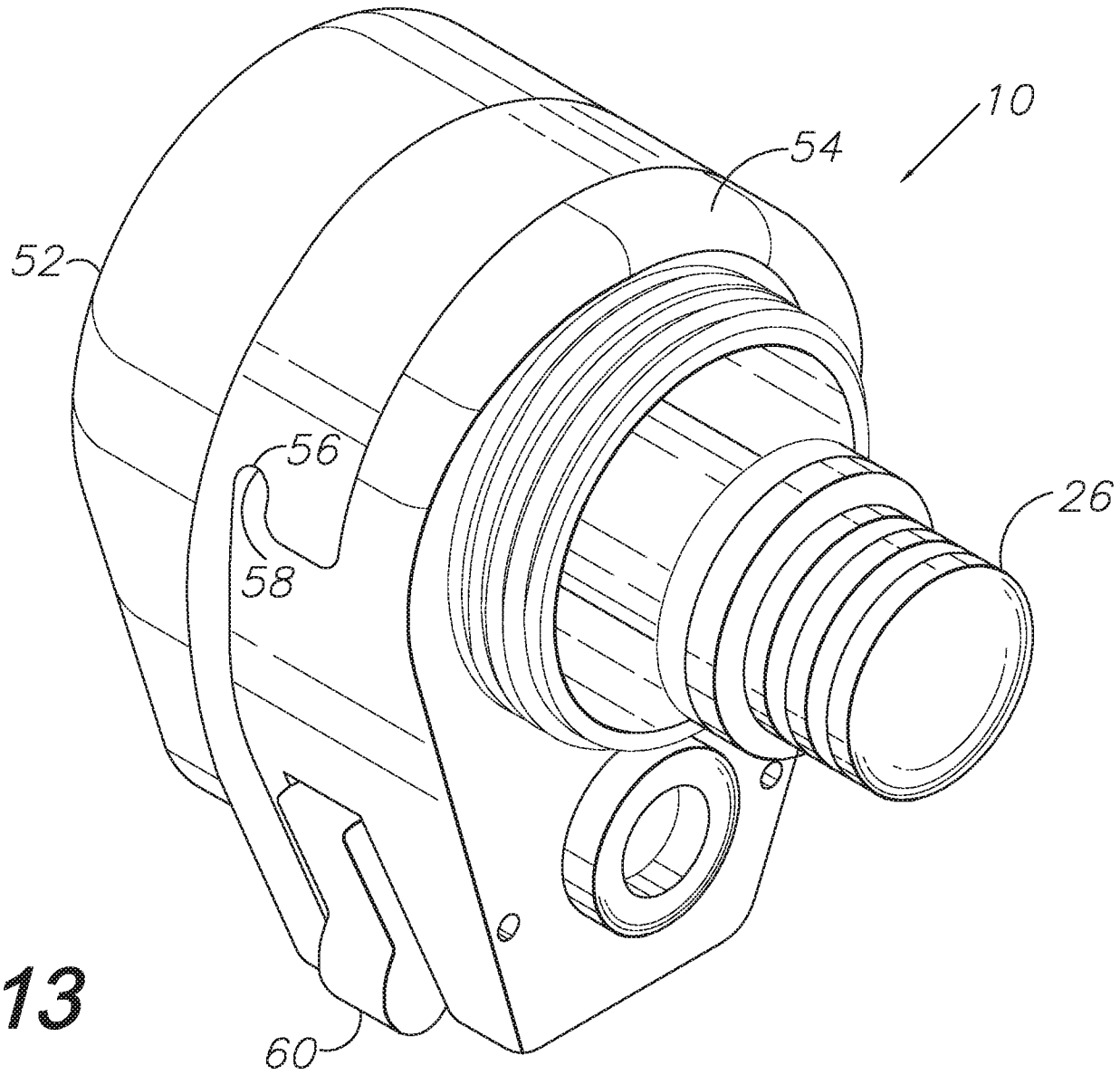
FIG. 13 is an upper, front, perspective view of a stock-receiver mounting assembly.
Figure 14:
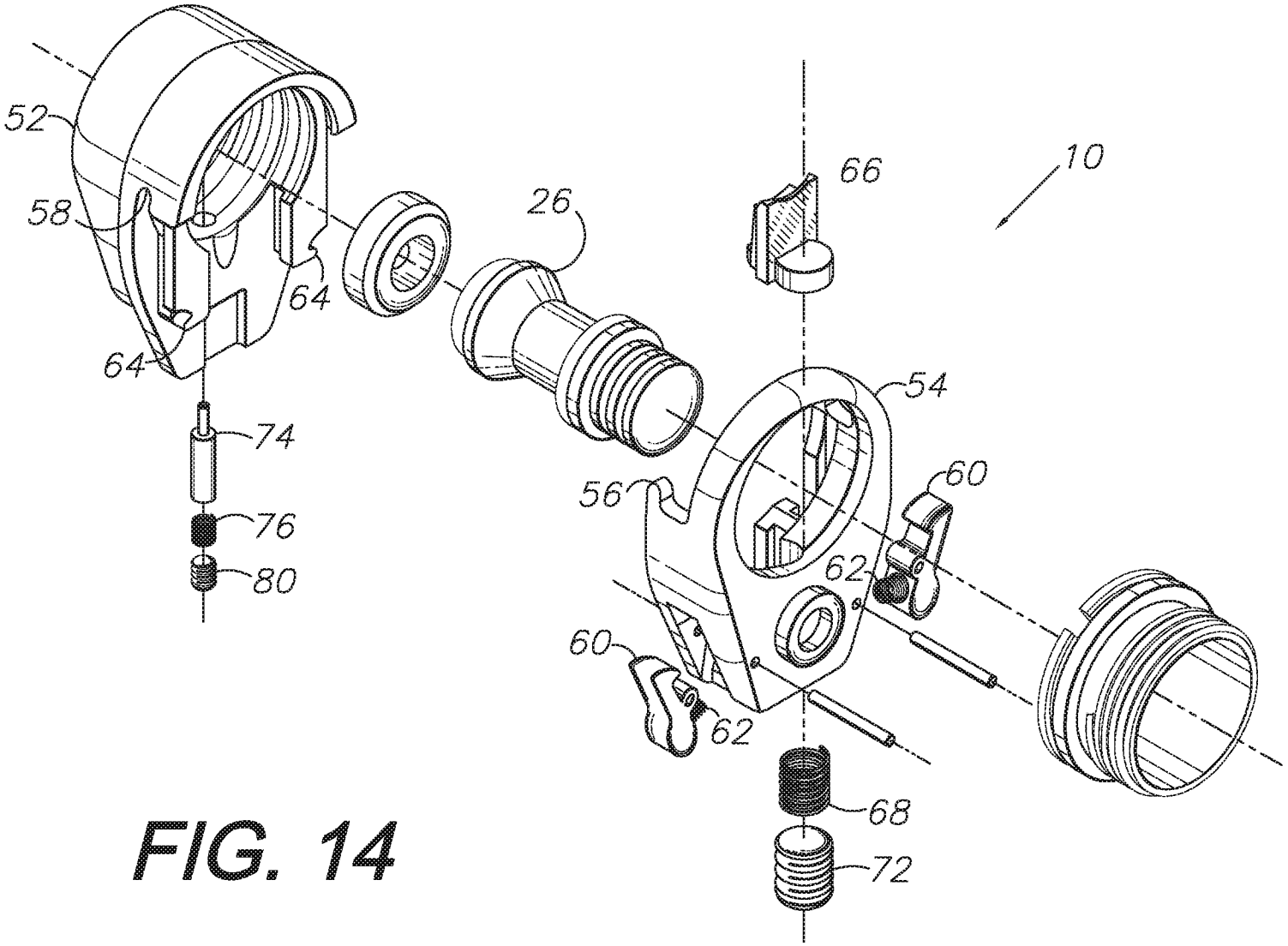
FIG. 14 is an upper, front, exploded view of the stock-receiver mounting assembly.
Figure 15:
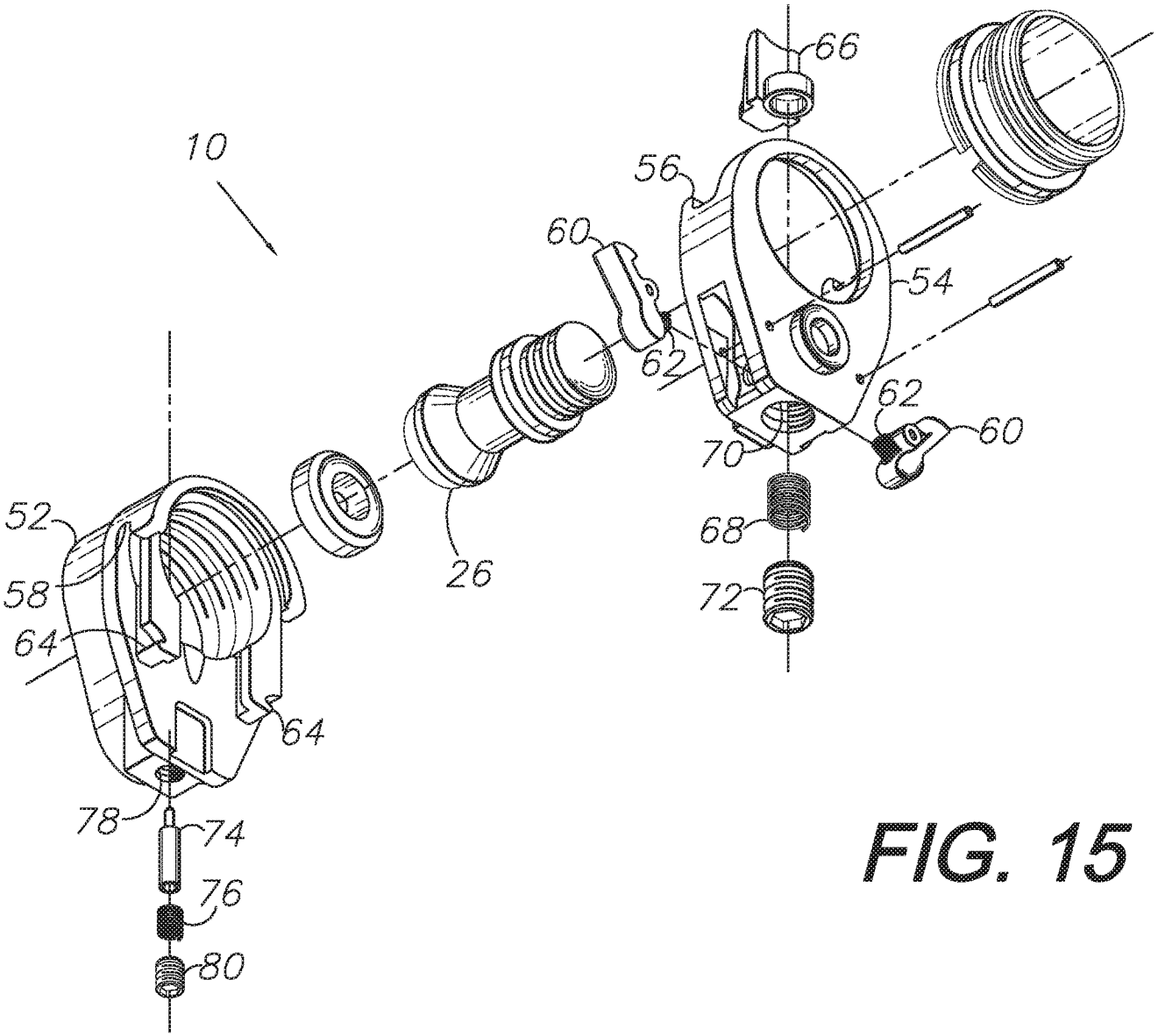
FIG. 15 is a lower, front, exploded view of the stock-receiver mounting assembly.
Figure 16:
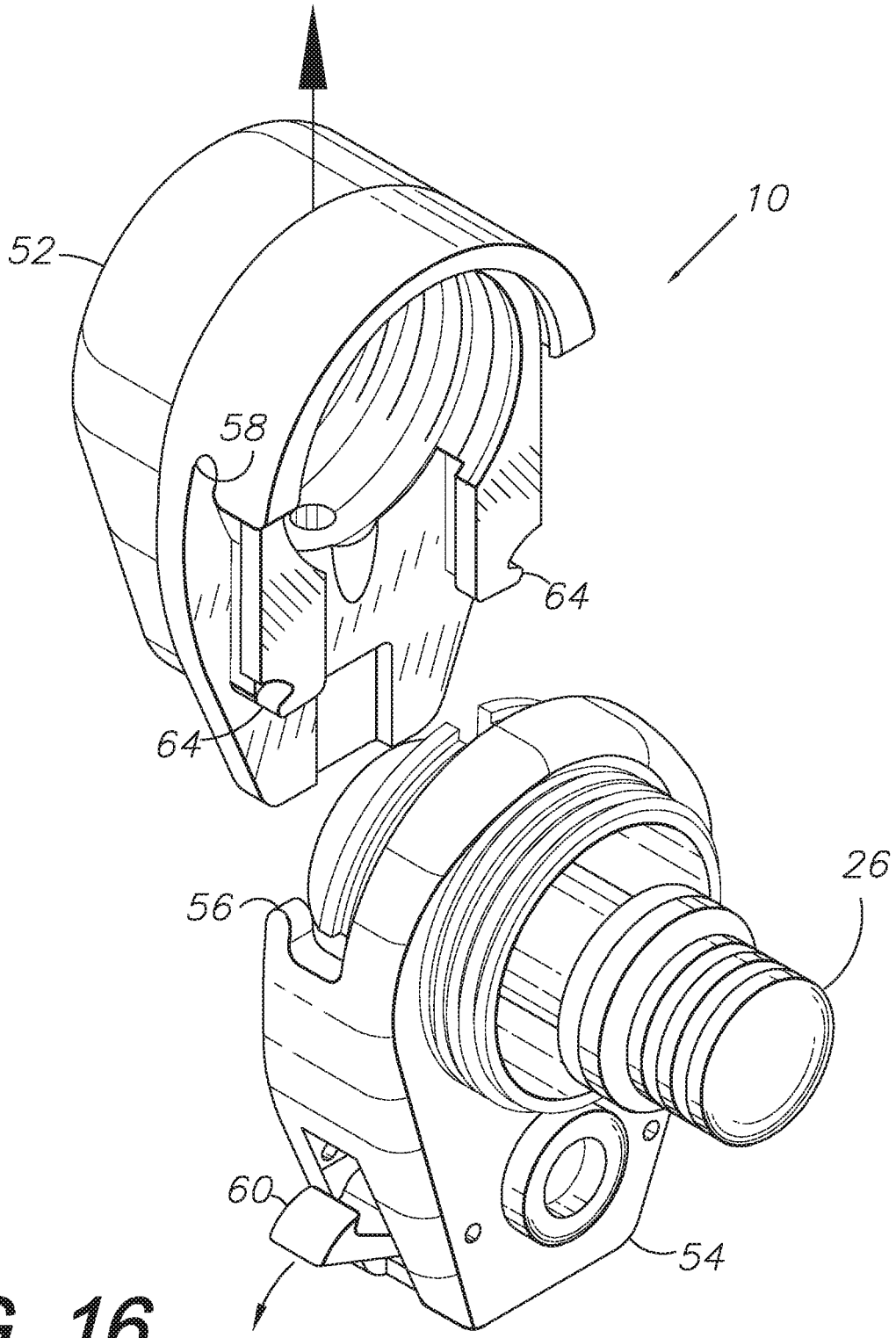
FIG. 16 is an enlarged, upper, front perspective view of the stock-receiver mounting assembly, with the front and back separated.
Figure 17:
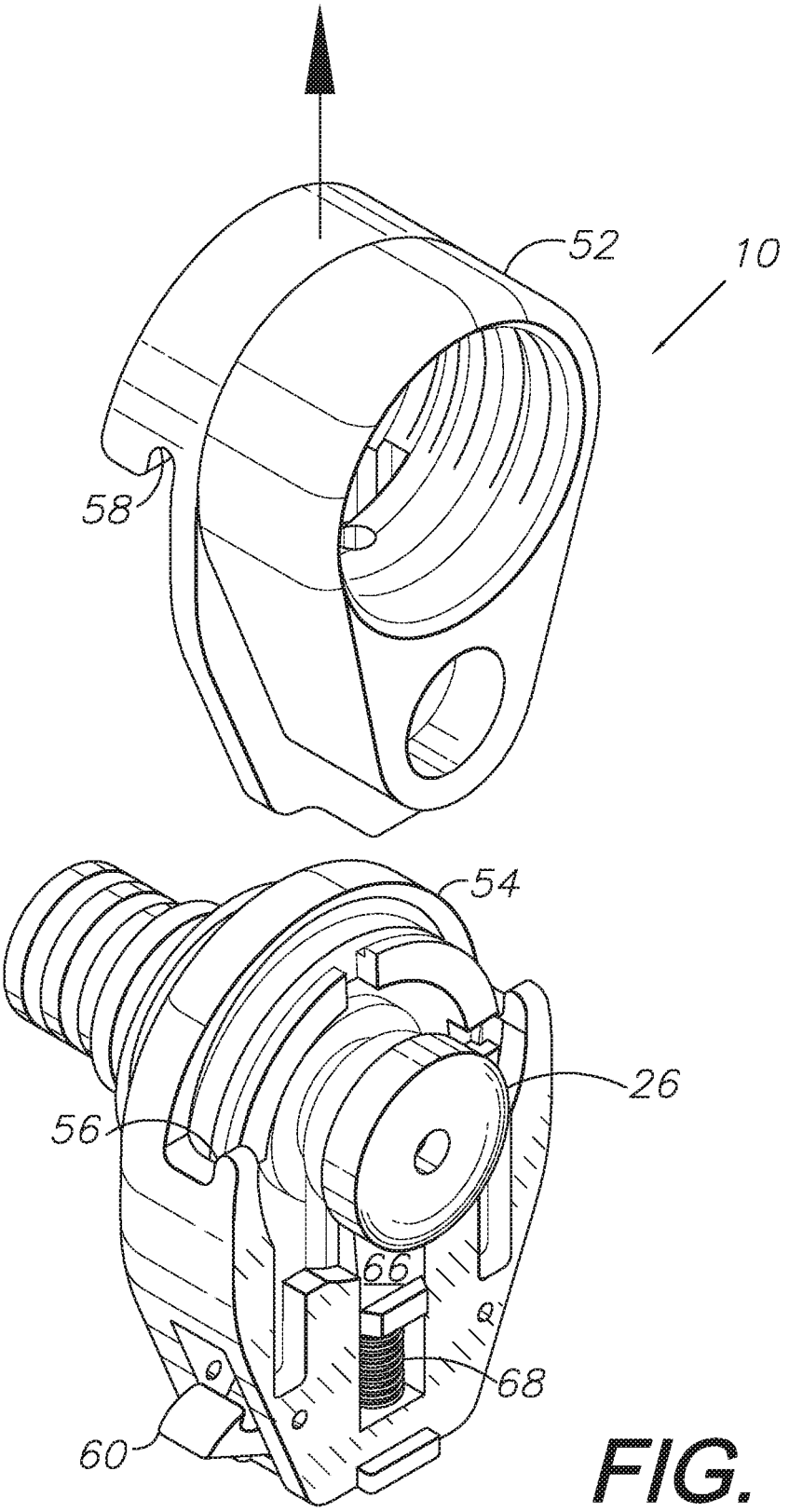
FIG. 17 is an enlarged, upper, rear, perspective of the stock-receiver mounting assembly, with the front and back separated.
Figure 18:
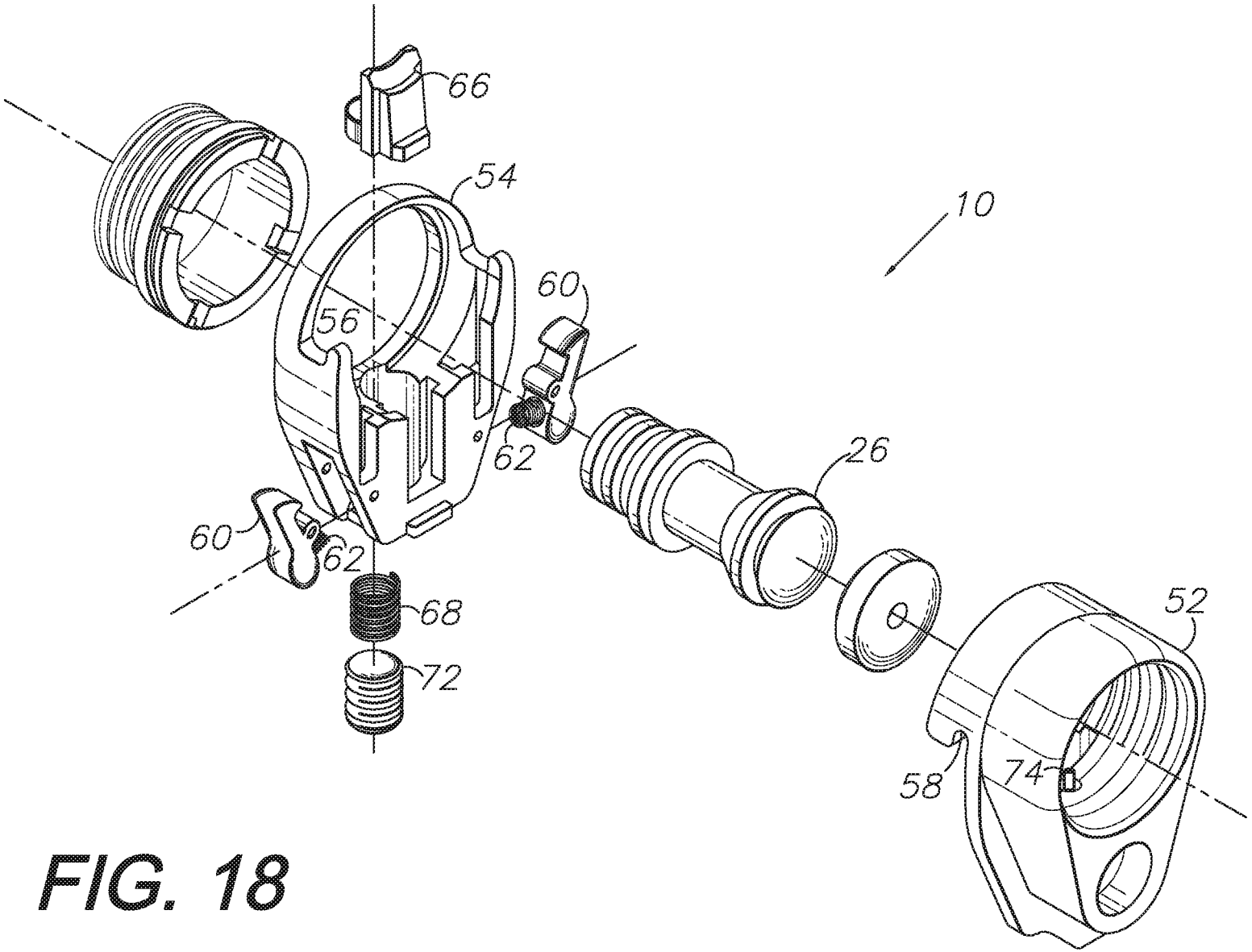
FIG. 18 is an upper, rear, exploded, perspective view of the stock-receiver mounting assembly.
Figure 19:
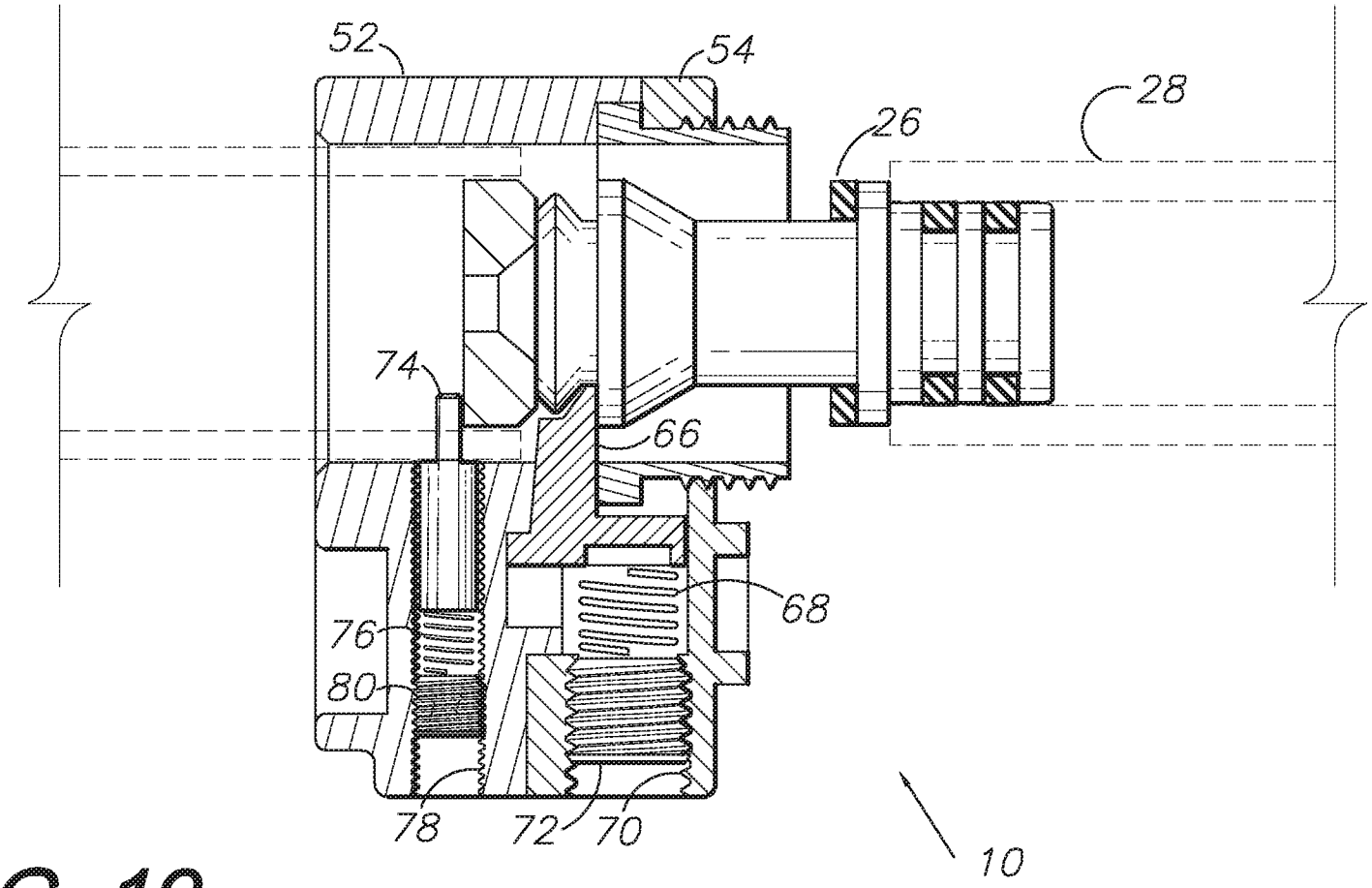
FIG. 19 is an enlarged, vertical, cross-sectional view of the stock-receiver mounting assembly, taken generally within circle 19 in FIG. 1.

FIGS. 13 and 14 show the stock-receiver mounting assembly 10 assembled and exploded respectively. The mounting assembly 10 generally includes a back 52 and a front 54, which are secured together by upwardly-extending tabs 56 received in downwardly-open slots 58. Retaining hooks 60 swing inwardly under pressure from compression springs 62, thus capturing corresponding flanges 64 in the mounting assembly back 52. Manually pressing the hooks 60 inwardly releases them from the flanges 64, enabling the back 52 to slide upwardly from the front 54 (FIGS. 16, 17) for disconnecting the stock assembly 4 from the receiver assembly 6. As shown in FIG. 19, a plug lock 66 in the stock-receiver mounting assembly back 52 is biased upwardly by a plug lock compression spring 68, which is retained in a threaded receiver 70 by a plug lock set screw 72. The stock-receiver mounting assembly back 52 also includes a buffer retaining pin 74 pushed upwardly by a compression spring 76, which is retained in a threaded buffer retaining pin hole 78 by a buffer retaining pin set screw 80.

IV. Receiver-Barrel Mounting Assembly 12

Figure 5:
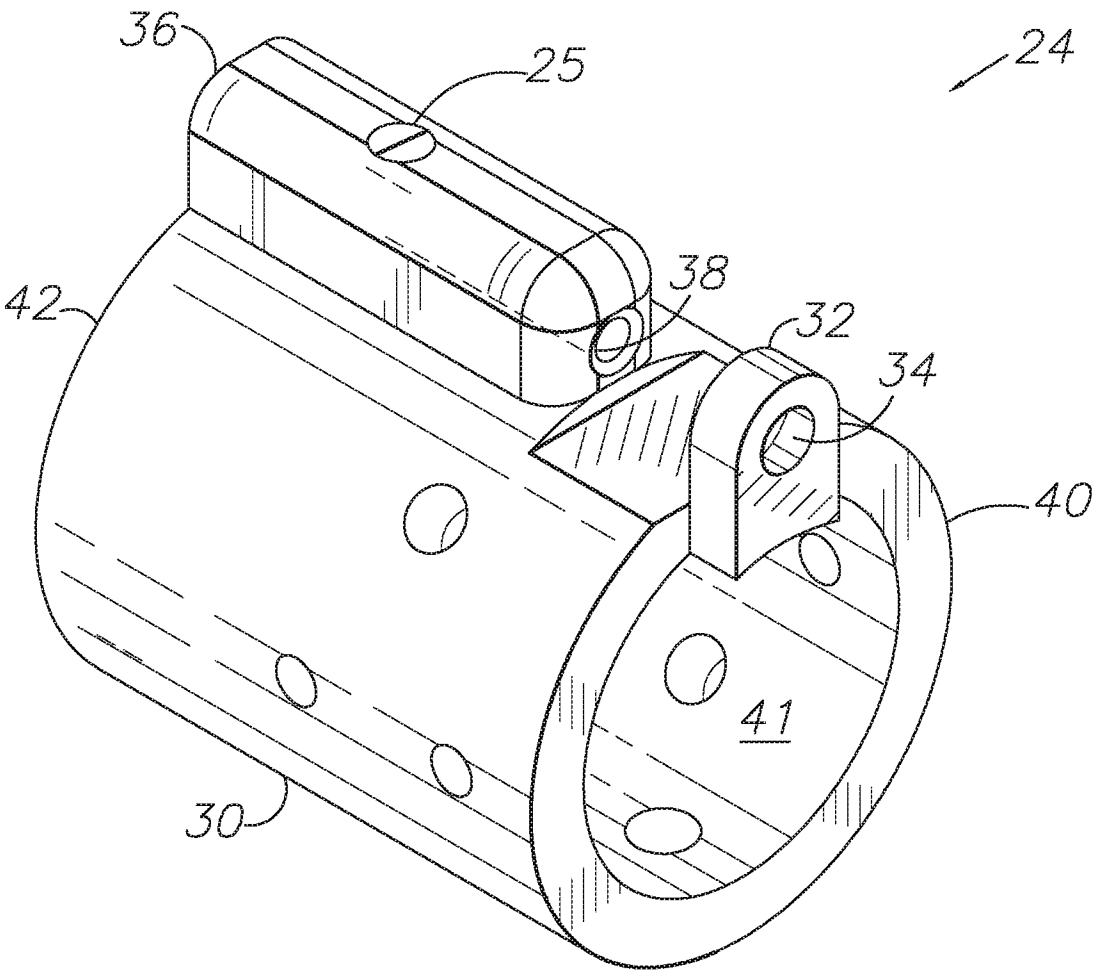
FIG. 5 is an enlarged, upper, front, perspective view of a barrel nut.
Figure 6:
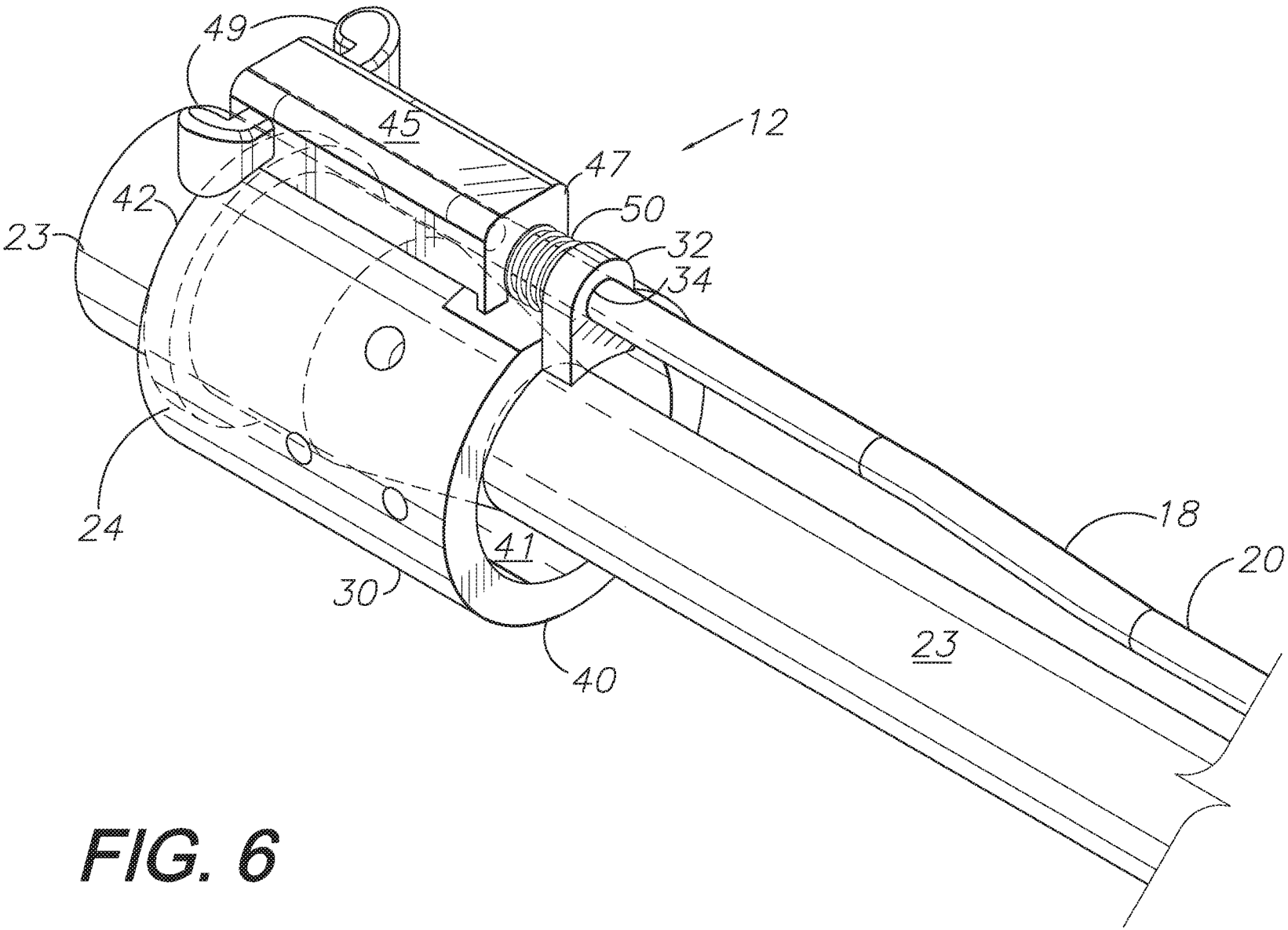
FIG. 6 is an enlarged, upper, front, perspective view of the barrel nut mounting a barrel lock and the barrel.
Figure 7:
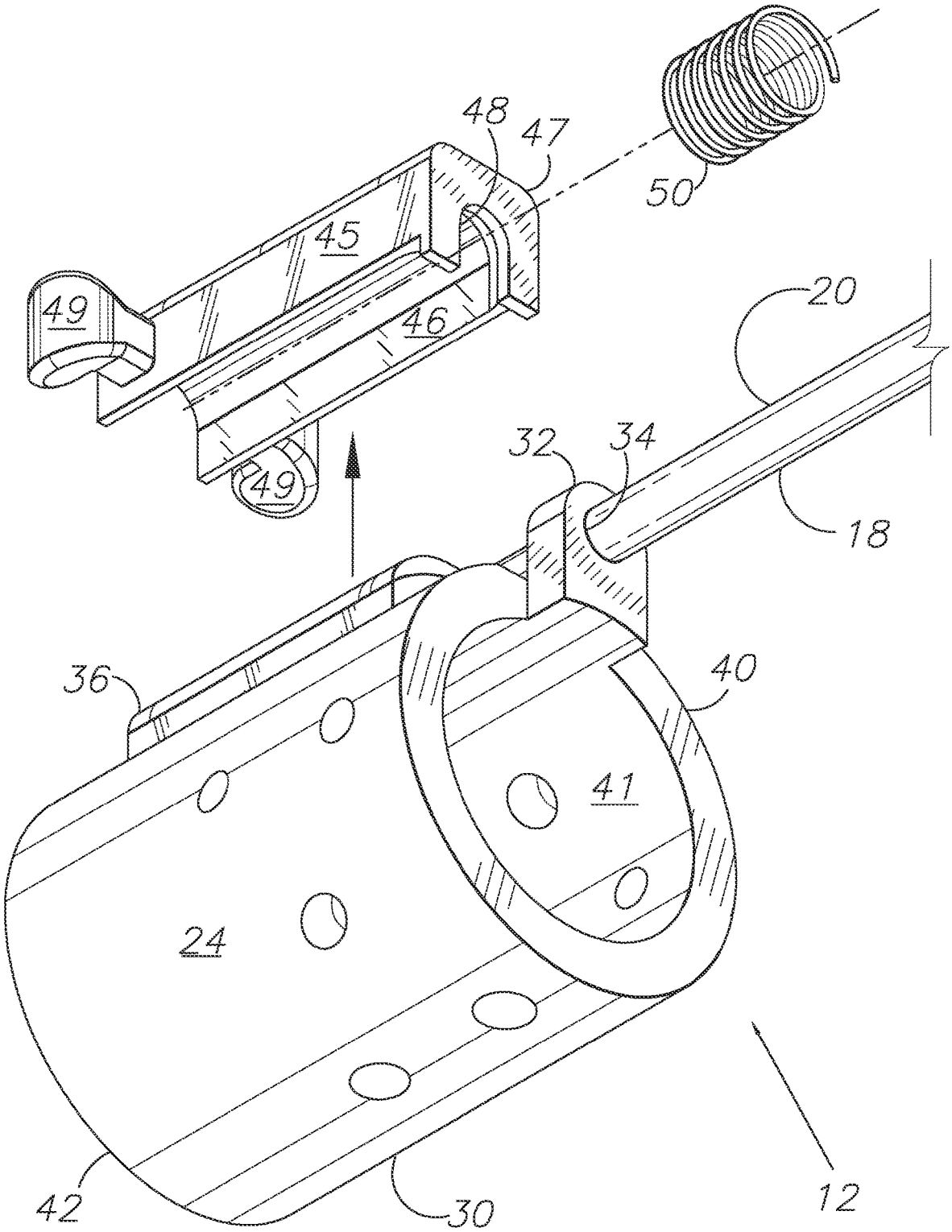
FIG. 7 is a lower, front, exploded, perspective view of the barrel nut, the gas tube, the barrel lock and a barrel lock spring.
Figure 8:
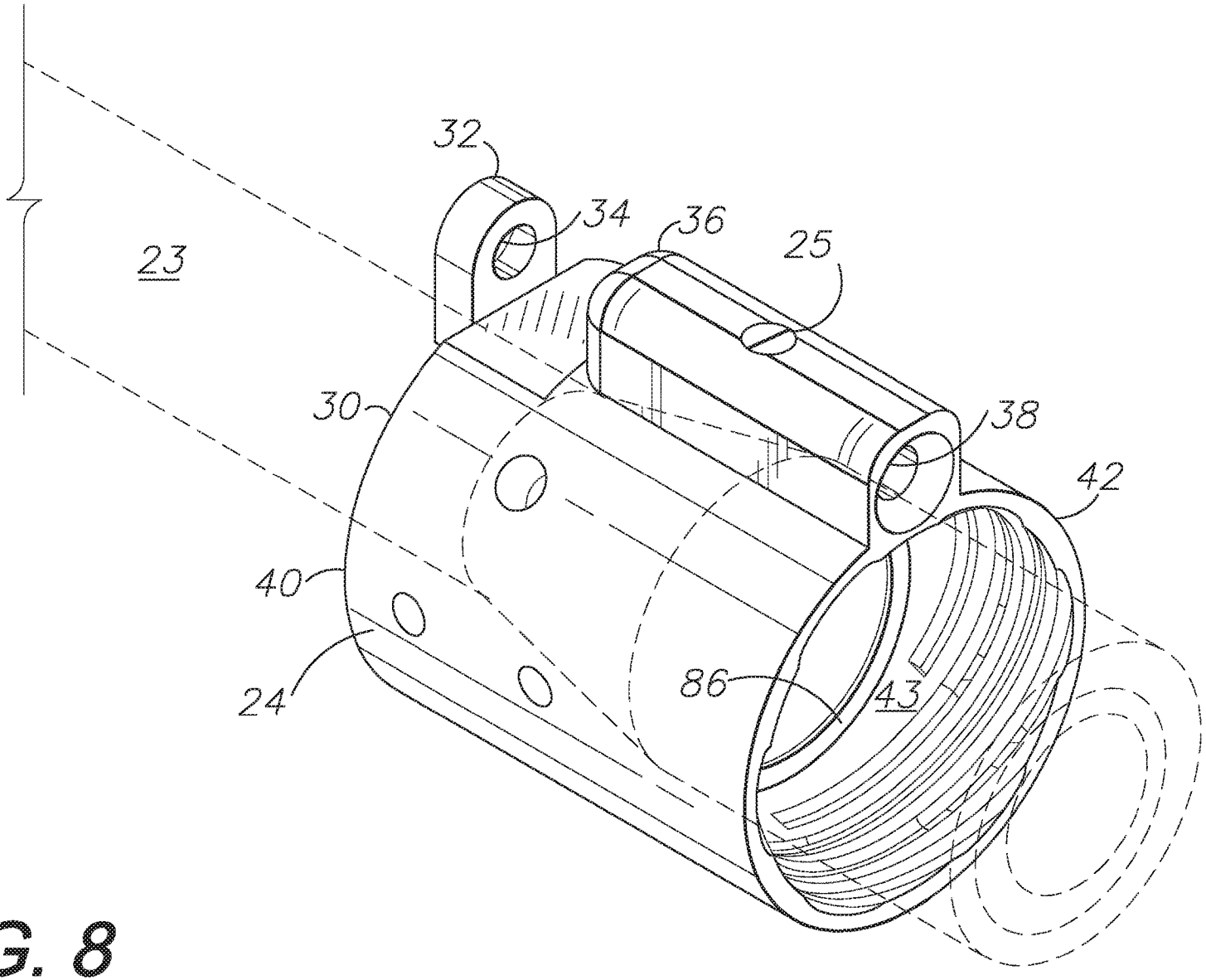
FIG. 8 is an upper, rear, perspective view of the barrel nut, with the barrel shown in hidden lines.

FIGS. 5 and 6 show the barrel nut 24, including a generally cylindrical, tubular barrel nut body 30 with a front tab 32 including a gas tube receiver 34 and a gas tube connection housing 36, under the barrel lock 45, with a passage 38 coaxially aligned with the receiver 34. The barrel nut 24 includes a front end 40 with a smooth bore for receiving the rear end of the barrel 23, and a barrel nut rear end 42 with a coarse-threaded bore 43 for receiving a correspondingly coarse-threaded extension 44 extending forwardly from the receiver assembly 6. The barrel lock 45 (FIGS. 6 and 7) includes a channel 46 receiving the gas tube connection housing 36 and a front end 47 with a gas tube passage 48. The barrel lock 45 can be slid forwardly on the barrel nut 24 by manually engaging barrel lock knobs 49 extending laterally from both sides, thereby compressing a barrel lock return spring 50 between the front tab 32 and the barrel lock front end 47 around the gas tube front section 20. The elongated charging handle 17 and the gas tube rear section 22 therein are accommodated by a bore 7 extending through the upper portion of the receiver assembly 6.

Figure 9:
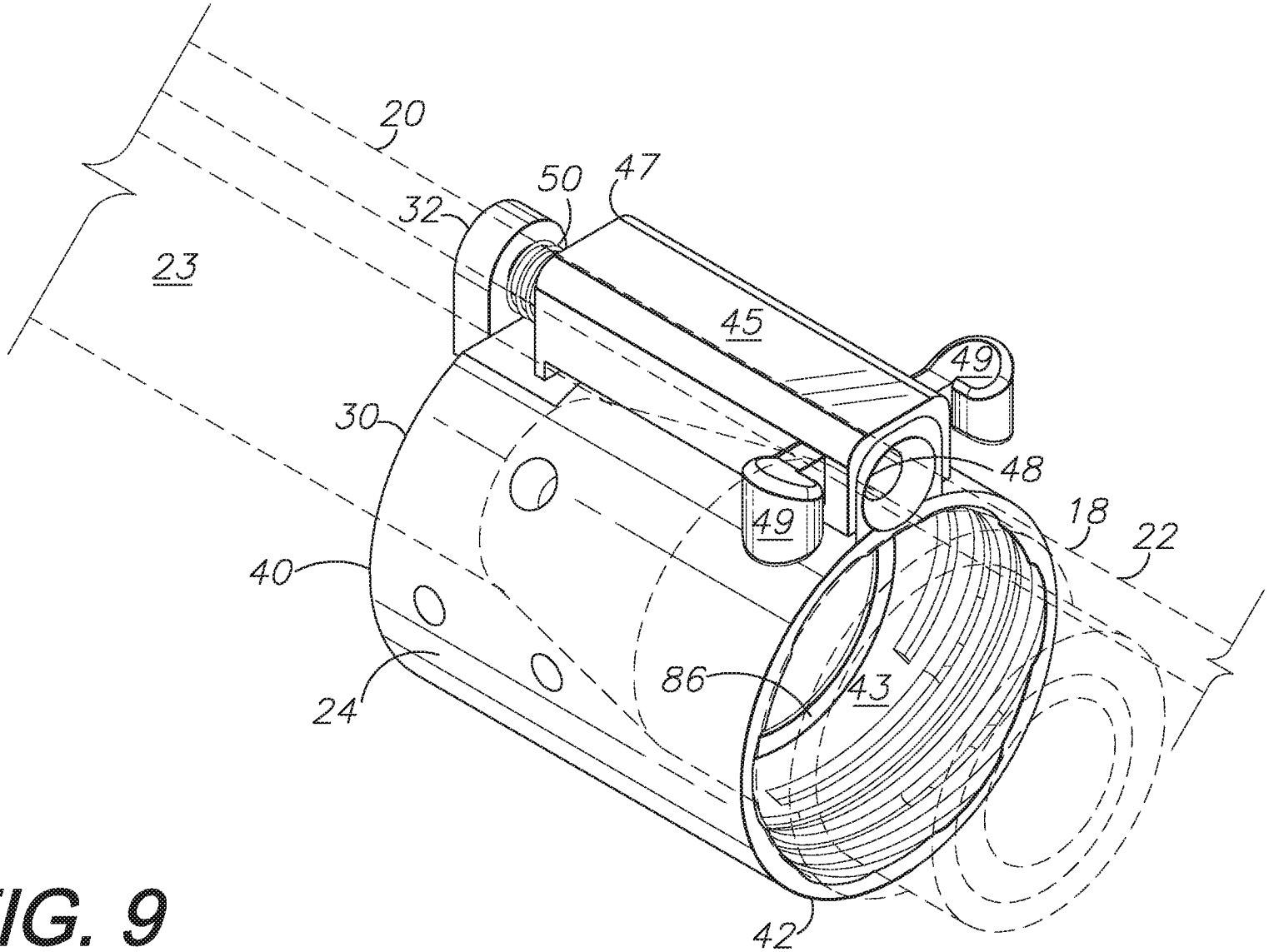
FIG. 9 is an upper, rear, perspective view of the barrel nut with the barrel lock, the barrel lock spring and the barrel.
Figure 10:
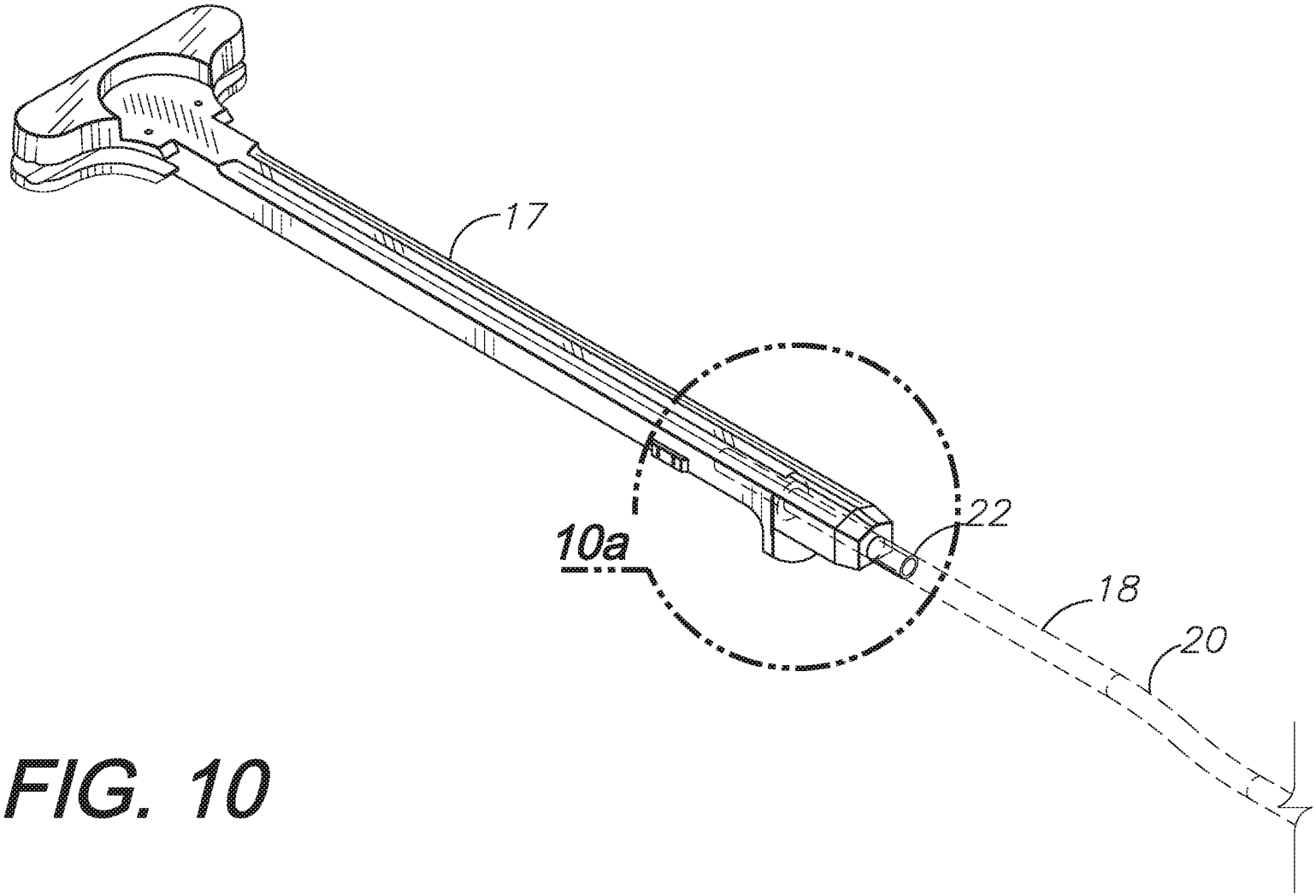
FIG. 10 is an upper, front, perspective view of a charging handle and a gas tube.
Figure 10A:
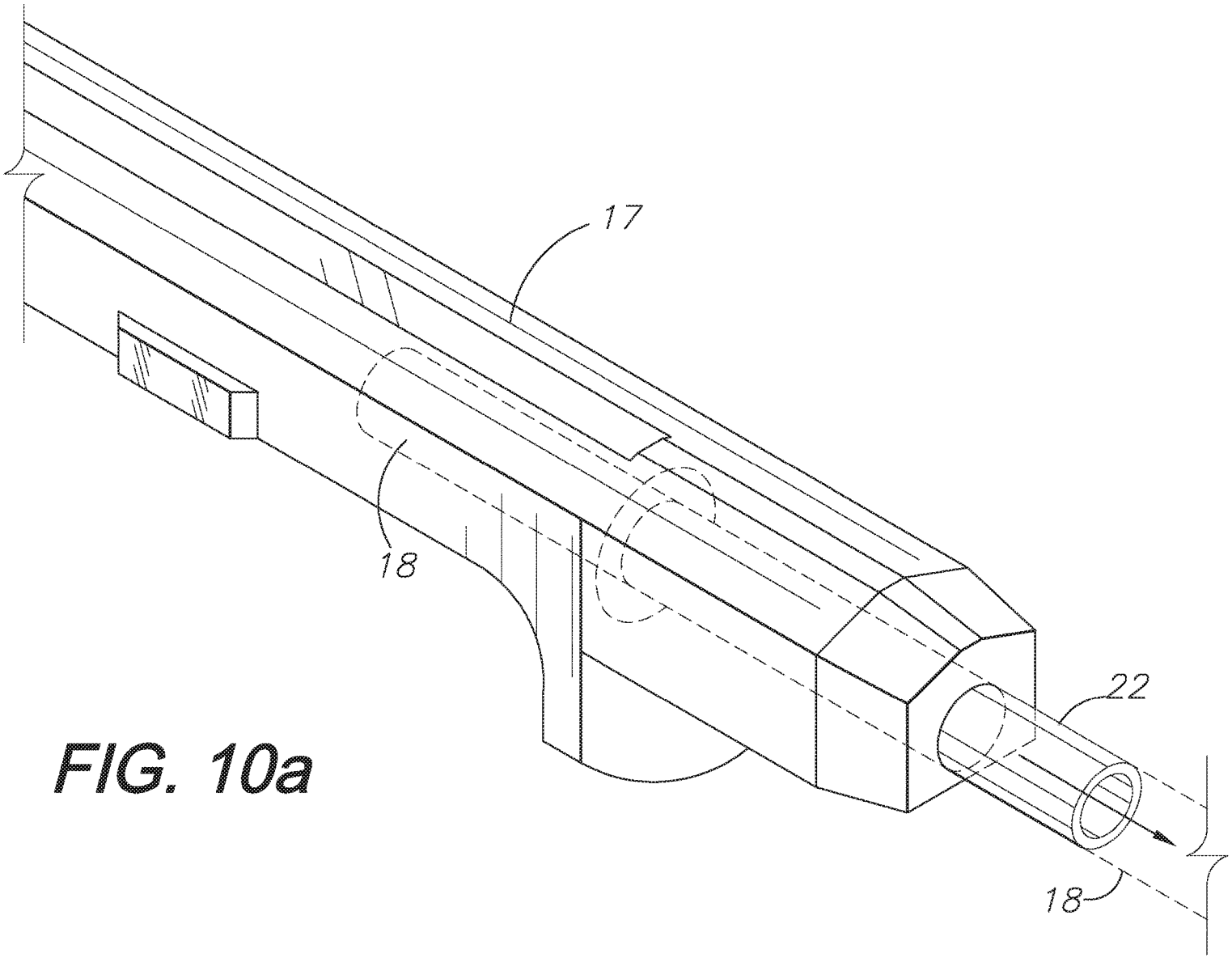
FIG. 10*a* is a fragmentary, enlarged, upper, front, perspective view of the charging handle and the gas tube, taken generally within circle 10*a* in FIG. 10.
Figure 11:
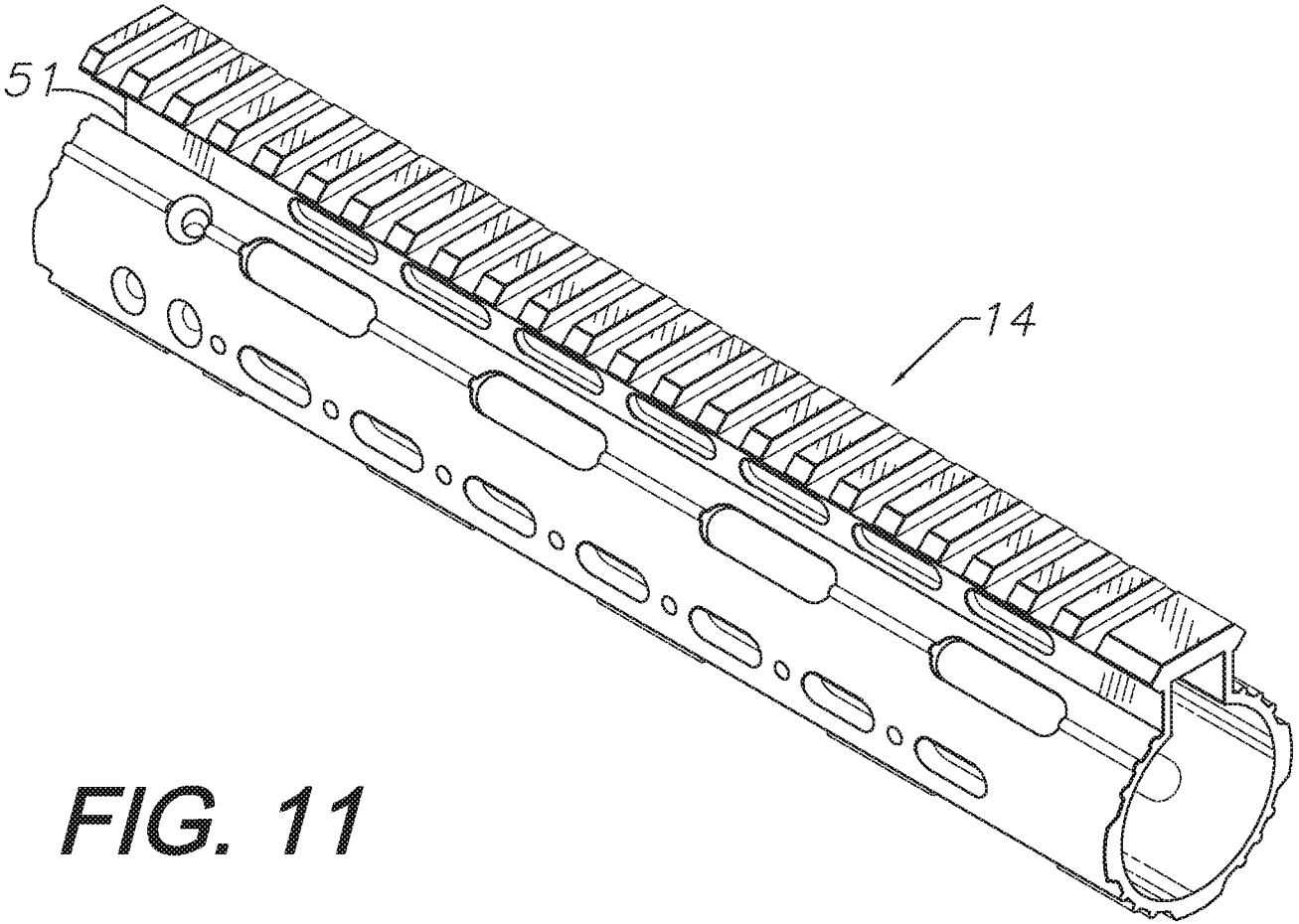
FIG. 11 is an upper, front, perspective view of a hand guard.
Figure 12:
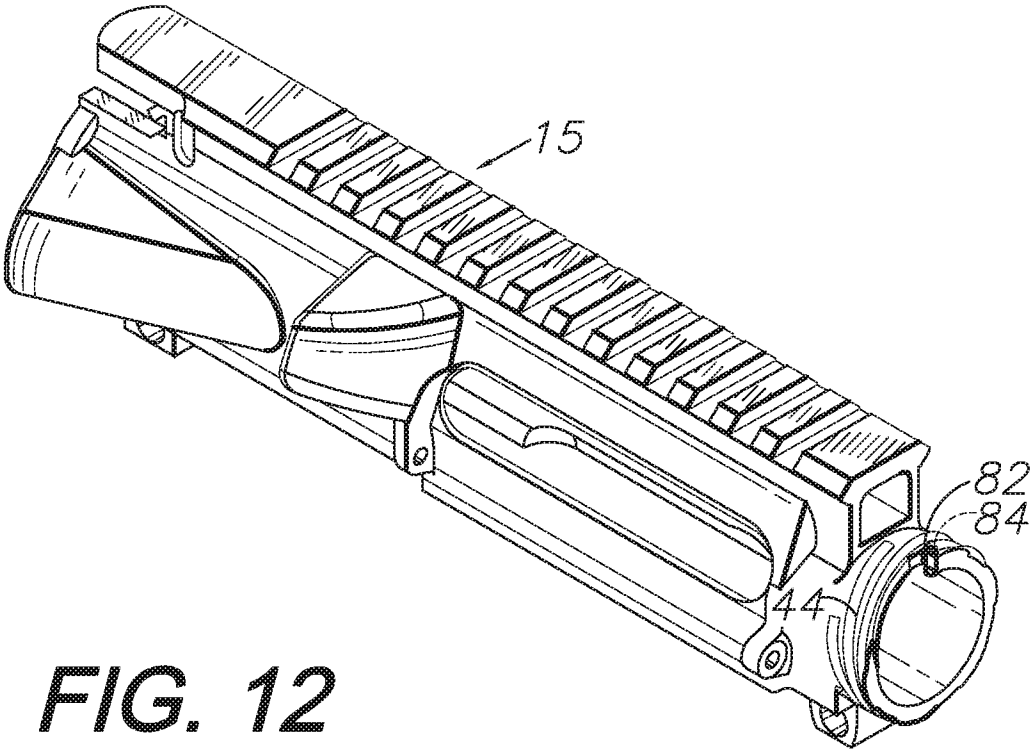
FIG. 12 is an upper, front, perspective view of an upper receiver cover.
Figure 20A:
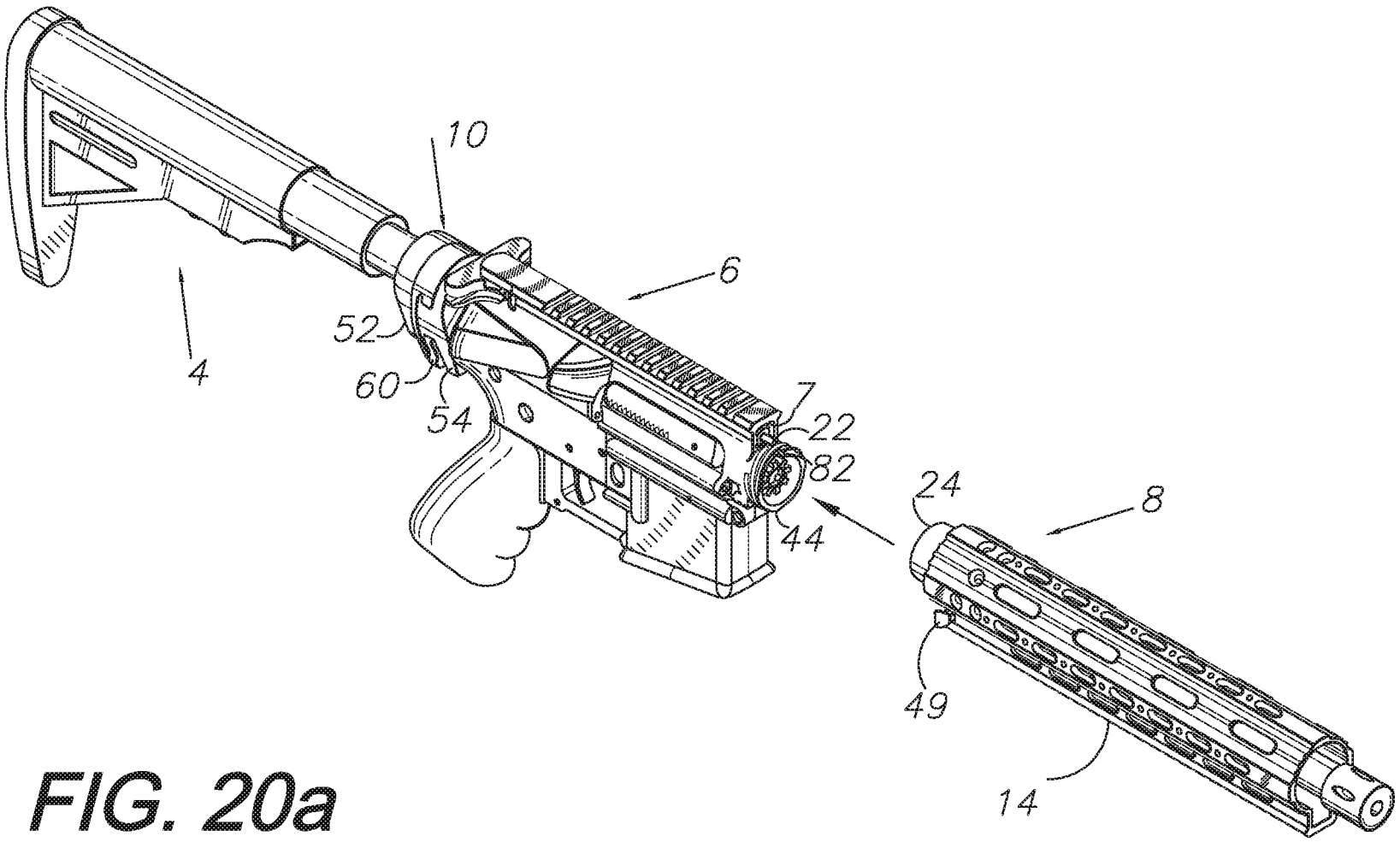
FIG. 20*a* is an upper, front, perspective view of the AR 15, with the barrel assembly upside down and aligned for placement on the receiver assembly.
Figure 20B:
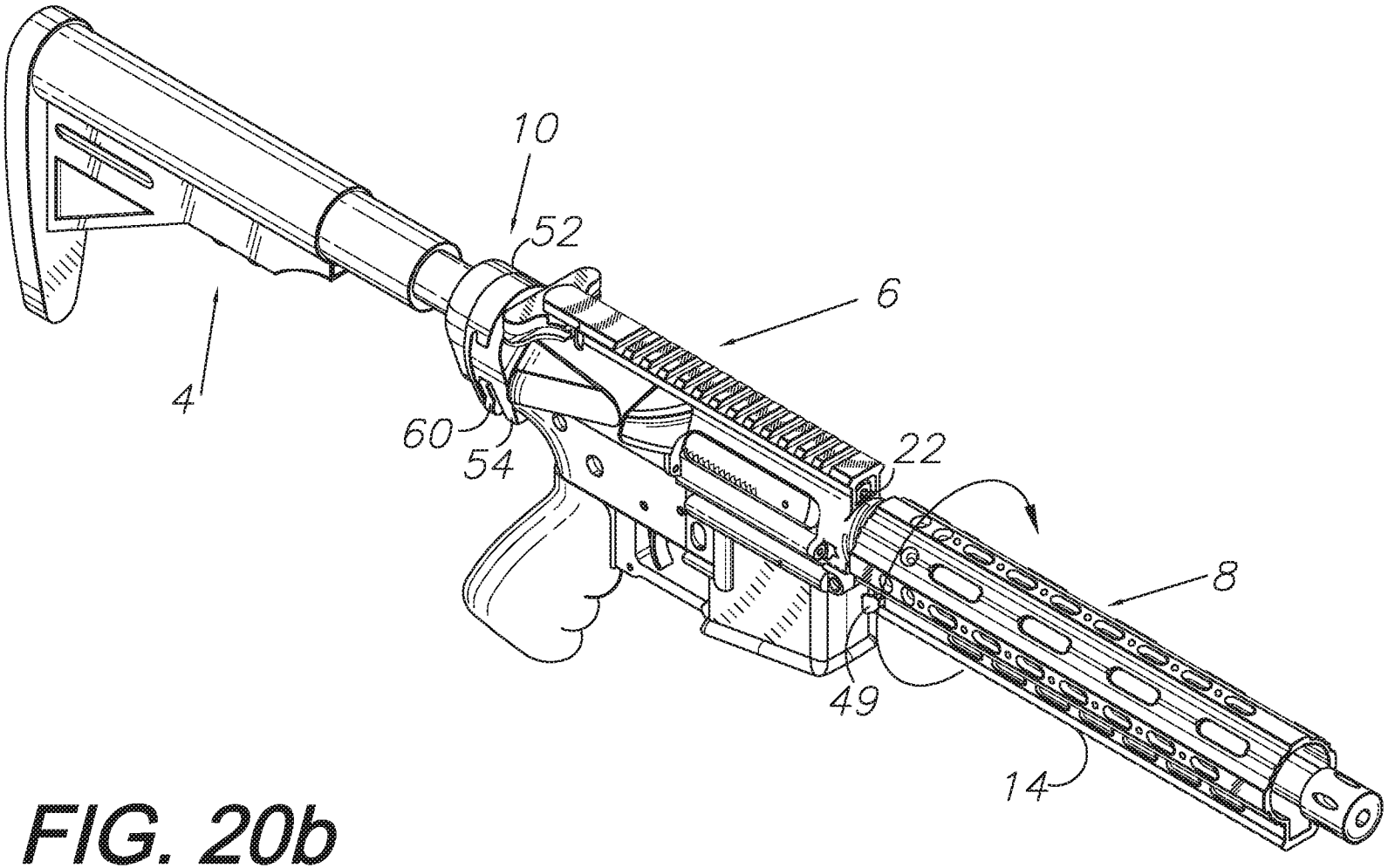
FIG. 20*b* is an upper, front, perspective view of the AR 15, with the barrel assembly upside down and placed against the receiver assembly.
Figure 20C:
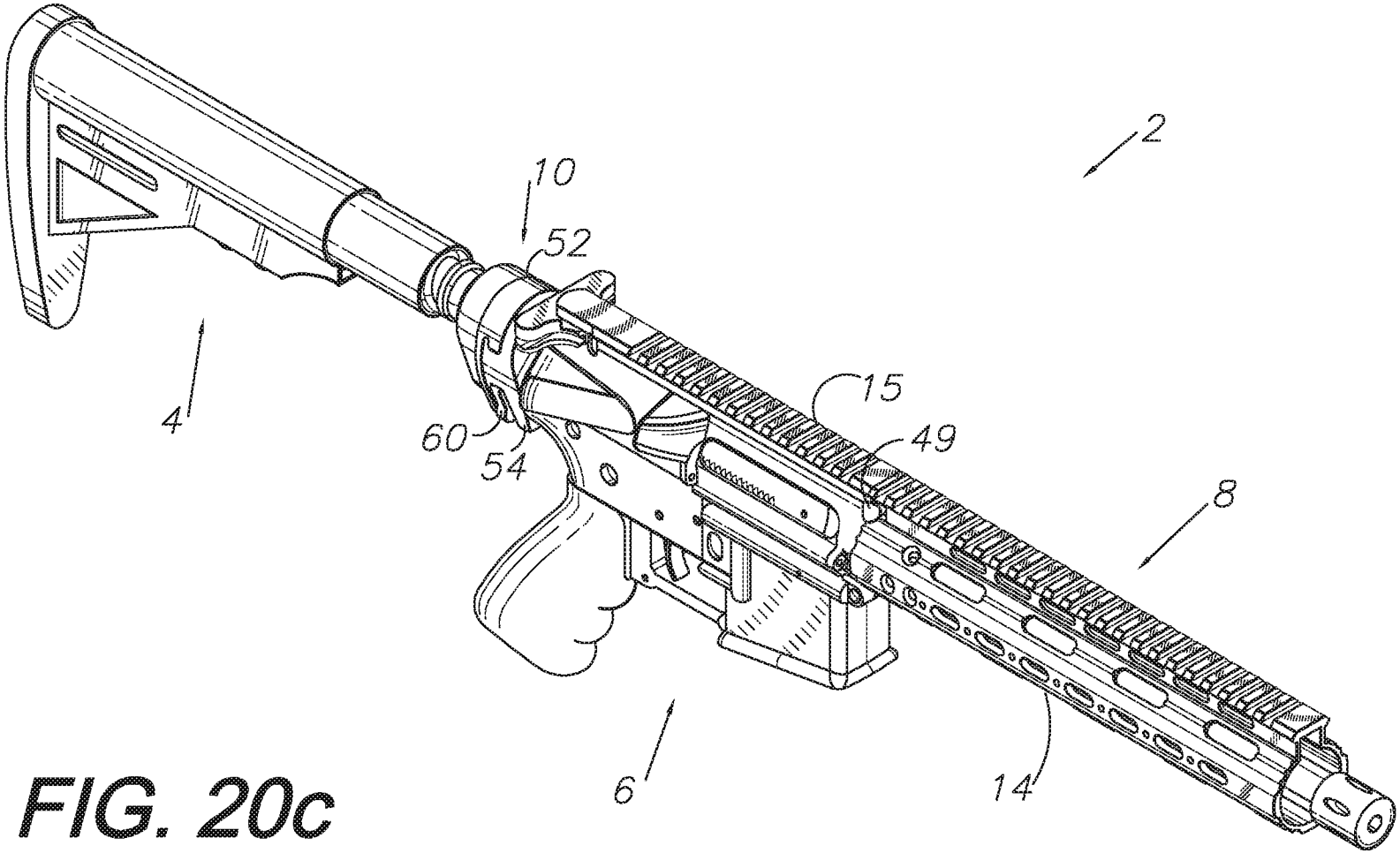
FIG. 20*c* is an upper, front, perspective view of the AR 15 with the barrel assembly installed on the receiver assembly.

The receiver-barrel mounting assembly 12 facilitates quickly mounting and dismounting the barrel assembly 8 on the receiver assembly 6. FIG. 20*a* shows the assemblies 6, 8 aligned, with the barrel assembly 8 upside down. FIG. 20*b* shows the assemblies 6, 8 pushed together, whereby the rear end of the barrel 23 extends into the receiver coarse-threaded extension 44. The coarse threads are configured for securing the barrel assembly 8 and the receiver assembly 6 with approximately 180° of rotation therebetween. The mounting rotation movement is limited by a pin 84 in the rear end of the barrel assembly 8 (between the barrel 23 and the barrel nut 24) engaging a stop 82 formed on the coarse-threaded extension 44*a* (FIG. 12). FIG. 20*c* shows the barrel assembly 8 in its operating (shooting) position relative to the receiver assembly 6. The barrel assembly 8 is locked in this position by the barrel lock tabs 49, which snap rearwardly to capture the upper receiver cover 15 between the tabs 49 with the firearm 2 in an assembled, use configuration (FIG. 20*c*). To facilitate a tight, threaded engagement, shims 86 can be placed within the -7- barrel nut 24 (FIG. 9) and over the rear end of the barrel 23 whereby the threads are securely tightened when the barrel assembly 8 is properly aligned with the receiver assembly 6 and further rotation is blocked by the engagement between the stop 82 and the pin 84. The barrel nut 24 includes a gas flow adjustment screw 25 for adjusting the gas flow, e.g., less gas flow when a suppressor is used on the AR 15 2.

Figure 21:
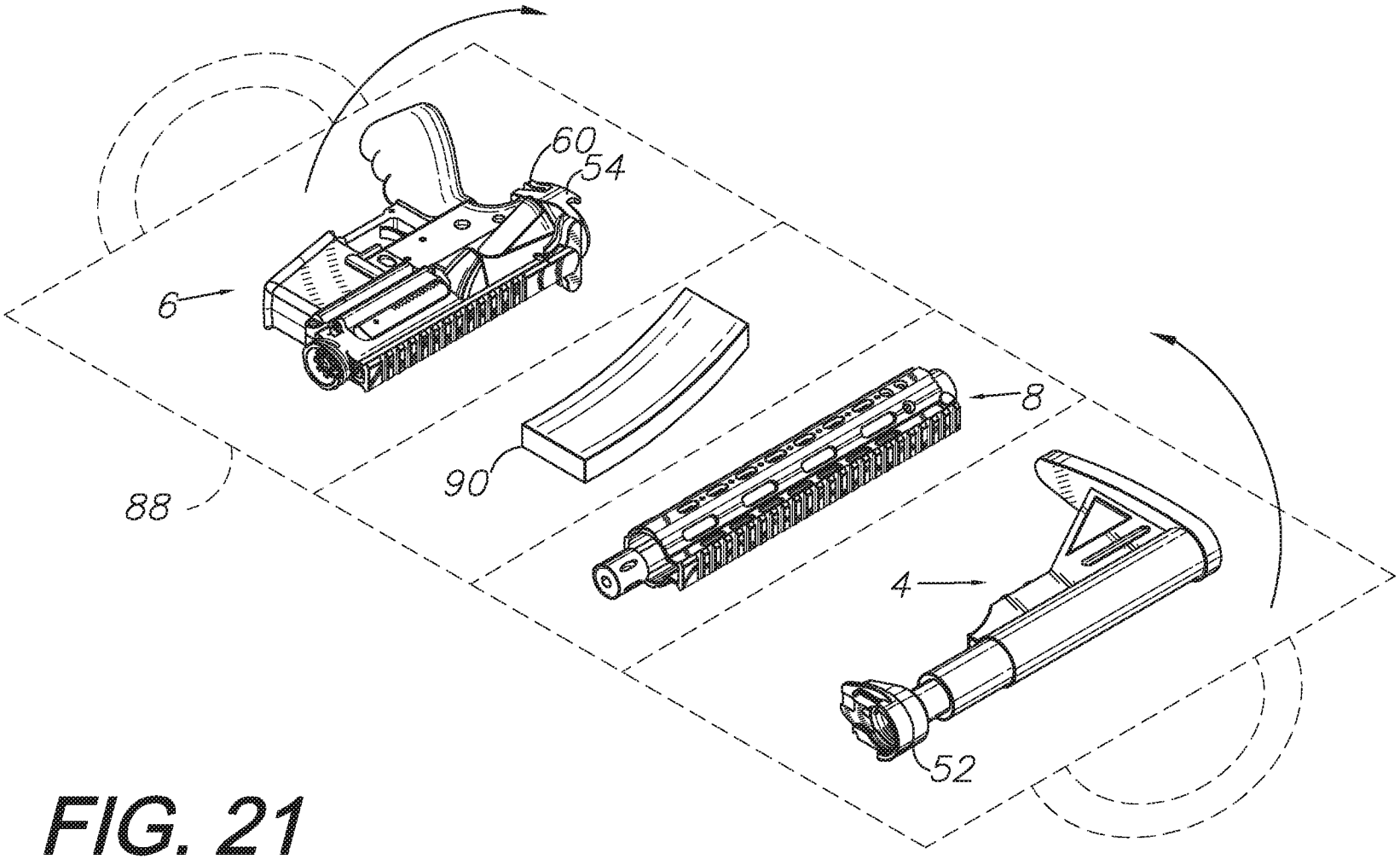
FIG. 21 is a perspective view of the disassembled AR 15 on a folding bag configured for transporting in a relatively compact configuration.

As shown in FIG. 21, the separated stock, receiver and barrel assemblies 4, 6, 8 can be placed in a suitable, foldable, multi-compartment carrying bag 88 for transportation in a relatively compact configuration. The carrying bag 88 can also receive one or more magazines 90, a scope, ammunition, a sling and other items, such as accessories and supplies.

Having described the preferred embodiments, it will become apparent that various modifications can be made without departing from the scope of the invention as defined in the accompanying claims. It is to be understood that while certain embodiments and/or aspects of the invention have been shown and described, the invention is not limited thereto and encompasses various other embodiments and aspects.

The invention claimed is:

1. A firearm configured for disassembly into receiver and barrel assemblies, which comprises:

a receiver-barrel mounting assembly including a threaded extension extending from said receiver assembly;

a barrel nut mounted on said barrel assembly and including a threaded bore and configured for threadably receiving said threaded extension;

a gas tube with a front section extending from said barrel assembly to said receiver-barrel mounting assembly and a rear section extending from said receiver-barrel mounting assembly to said receiver assembly;

said gas tube sections configured for separation at said receiver-barrel mounting assembly with said barrel assembly separated from said receiver assembly;

said gas tube configured for conveying pressurized discharge gas to power said receiver assembly through an ejection-reload cycle with said barrel assembly mounted on said receiver assembly in an operating configuration;

a receiver extension extending forwardly from said receiver;

said barrel nut receiving a rear end of said barrel and including a threaded bore adjacent to said barrel rear end;

said barrel assembly including a barrel with front and rear ends and a handguard with front and rear ends in proximity to said barrel front and rear ends;

said handguard having an upper rail extending between said handguard front and rear ends, said handguard having front and rear ends, said;

said handguard upper rail rear end having a pair of rearwardly-open lock tab slots each located on a respective side of said hand guard upper rail;

said barrel nut configured for threadably receiving said receiver extension with said barrel assembly mounted on said receiver assembly in said operating configuration; and said receiver assembly and said barrel assembly are configured for rotating between assembled and disassembled configurations of the firearm through approximately 180°;

a gas tube connection housing with front and back ends; said gas tube connection housing mounted on said barrel nut;

said gas tube connection housing including a passage extending between and open at said gas tube connection housing front and back ends; and with said firearm assembled, said passage receiving a front section of said gas tube extending through said gas tube connection housing front end and said passage receiving a back section of said gas tube extending through said gas tube connection housing back end;

a first locking mechanism configured for locking said barrel and receiver assemblies together and preventing relative rotation therebetween, said first locking mechanism comprising a gas tube connection housing receiving a front end of said gas tube rear section and a rear end of said gas tube front section;

a second locking mechanism configured for locking said barrel and receiver assemblies together and preventing relative rotation therebetween, said second locking mechanism comprising a pair of barrel lock tabs extending laterally from opposite sides of said gas tube connection housing, said barrel lock tabs having: a forward, locked position with each received in a respective barrel lock tab slot; and a rearward, unlocked position rear extracted from said barrel lock tab slots; and said second locking mechanism including a compression spring between said front tab and said barrel lock and configured for biasing said locking tabs rearwardly into said barrel lock tab slots.

2. The firearm according to claim 1, which includes:

a stock assembly including front and back stock assembly ends;

a stock-receiver mounting assembly including a back mounted on said stock assembly front end and a front mounted on said receiver back end; and said stock-receiver mounting assembly having a coupling mechanism with an unlocked configuration for decoupling said stock and receiver assemblies and an operating configuration coupling said stock and receiver assemblies.

3. The firearm according to claim 1, which includes at least one shim configured for placement within the barrel nut and over the rear end of the barrel for securely tightening the barrel assembly on the receiver assembly.

4. The firearm according to claim 1, wherein said gas tube connection housing on said barrel nut includes a gas flow adjustment screw configured for increasing and decreasing gas flow from said gas tube front section to said gas tube rear section.

* * * * *